United States Patent [19]

Scantlebury et al.

[11] 4,261,603

[45] Apr. 14, 1981

[54] HOLDER FOR WINDOW

[76] Inventors: Clifford V. Scantlebury; Carolyn S. Scantlebury, both of 4717 Upland Dr., Erie, Pa. 16509

[21] Appl. No.: 13,471

[22] Filed: Feb. 21, 1979

[51] Int. Cl.[3] ..... E05C 3/04

[52] U.S. Cl. ..... 292/204; 292/238

[58] Field of Search ..... 292/204, 338, 202, 238, 292/205, 206, DIG. 47

[56] References Cited

U.S. PATENT DOCUMENTS

| | | | |
|---|---|---|---|
| 284,993 | 9/1883 | Abele | 292/204 |
| 398,884 | 3/1889 | Eberhardt | 292/204 |
| 749,469 | 1/1904 | Assorati | 292/204 |
| 1,718,661 | 6/1929 | Nightingale | 292/202 |
| 1,925,244 | 9/1933 | Goodrich | 292/338 X |
| 1,957,113 | 5/1934 | Smith | 292/238 |
| 2,129,957 | 9/1938 | Pearson | 292/338 X |
| 2,202,561 | 5/1940 | Lahiere et al. | 292/238 |
| 2,335,421 | 11/1943 | Kent | 292/202 |

*Primary Examiner*—Richard E. Moore

*Attorney, Agent, or Firm*—Charles L. Lovercheck

[57] ABSTRACT

A holder for a window made up of a holder bracket and a lever having a frictional end pivoted to the bracket. The bracket is attached to the window frame so that the lever frictional end can swing down and engage the window at an acute angle to the window so that it will hold the window and prevent it from sliding down. The lever can also be swung up so that the frictional end will engage the window below the pivot to prevent the window from being raised.

1 Claim, 4 Drawing Figures

HOLDER FOR WINDOW

GENERAL DESCRIPTION OF THE INVENTION

While the primary purpose of the device is to hold the window open at any desired level, a secondary use is to make it difficult to open the window from the outside when the position of the device is reversed.

When the window is being raised the lever easily rides the surface of the window. After the window has been raised the desired amount and is allowed to fall the friction of the window on the soft tip pulls the lever arm down. Due to the distance from pivot point to the end of the tip being greater than the distance from the pivot point to the window, the window is not able to fall.

To lower the window it is raised slightly and the lever is held back allowing the window to be lowered.

REFERENCE TO PRIOR ART

A general type of window lock of the type disclosed is shown in U.S. Pat. No. 2,524,940. This patent shows a lock for a window constructed in such a manner that it has various disadvantages over the lock disclosed herein.

OBJECTS OF THE INVENTION

It is an object of the invention to provide an improved window lock.

Another object of the invention is to provide a window lock that will hold a window in open position and can also be used to hold the window in closed position.

Another object of the invention is to provide a lock for a window that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
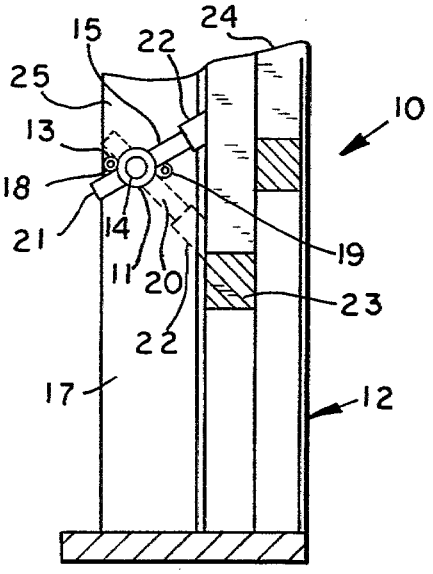
FIG. 1 is a longitudinal cross-sectional view of a window and lock according to the invention, showing the lock in position to hold the window raised in full lines and showing the lock in position to prevent the window from being raised in phantom lines.

Now, with more particular reference to the drawings, I show a lock and window combination indicated generally at 10 made up of a lock 11 and a window 12. The lock has a bracket 13 and a lever 15 pivoted to the bracket by pivot 14. The pivot 14 is a stud which is a force fit into the bracket at its first end and has a head 17 on the second end and the second end is smaller in diameter than the hole in the lever so that the lever can turn on the pivot pin. The bracket is attached to the window frame 17 by screws in holes 18 and 19. The lever 15 has a first end 20 and a second end 21. The first end 20 may have a soft tip 22 which may be made up of latex rubber or other soft pliable material having a relatively high coefficient of friction on wood or metal and that will not injure the surface of the window sash 23.

The window shown is the usual type of double hung window having an upper sash 24 and a lower sash 23 that slide up and down relative to each other. The window has a frame 17 to which the bracket 13 may be attached by means of flat head screws in holes 18 and 19 as stated above.

The bracket 13 has a boss which holds the lever 15 out in spaced relation to the bracket in an amount sufficient that the tip 22 will clear the bracket.

To operate the lock, the window sash to be held in place will be moved to a position in which it is desired to be held. For example, if the sash 23 in FIG. 1 is in the position shown, it will be moved to that position and the lever will then be swung clockwise so that the lever is at an acute angle to the horizontal extending to the vertical in the direction opposite that the window sash is inclined to be moved by gravity. The soft tip will then be pushed down against the window frame hard enough to wedge the lever in place. In FIG. 1 the lock is shown in dashed lines in a position to prevent the sash 23 from being raised. In this instance, the window lever 15 will be swung in a counterclockwise direction and the soft tip 22 will be pushed into engagement with the window.

Figure 2:
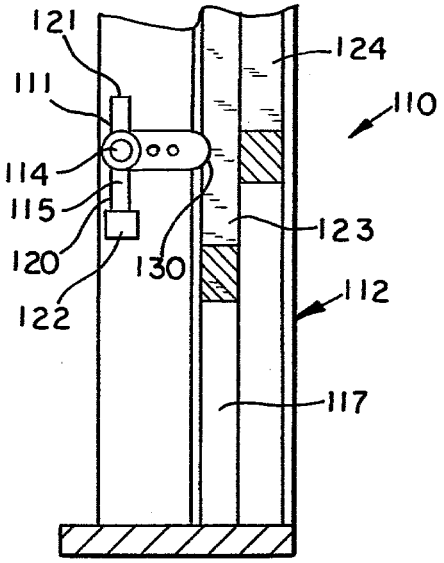
FIG. 2 is a view similar to FIG. 1 showing the lock released so that the window can be raised or lowered.
Figure 3:
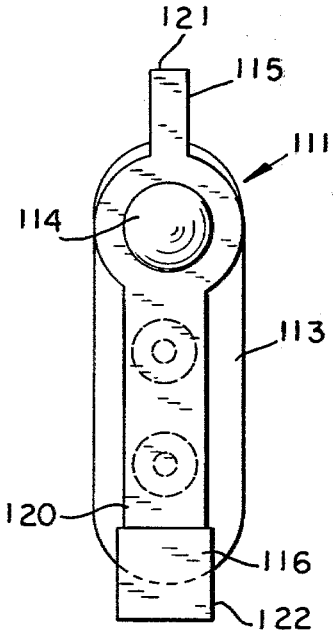
FIG. 3 is an enlarged side view of the lock according to the invention adapted to be supported on a window.
Figure 4:
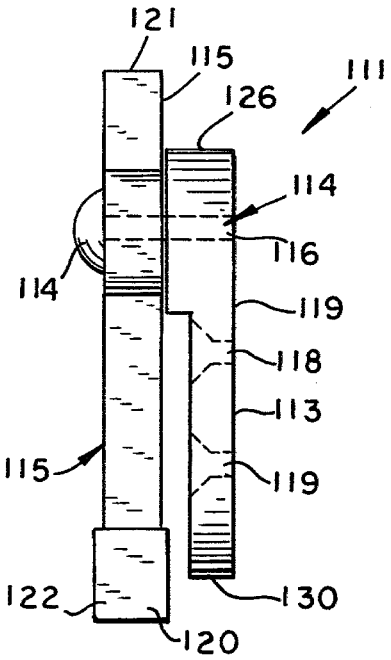
FIG. 4 is an enlarged front view of the lock of FIG. 1.

In the embodiment of the invention shown in FIGS 2, 3 and 4, we show a combination window and lock indicated generally at 110 made up of a lock 111 and a window 112. The lock has a bracket 113 and a lever 115 pivoted to the bracket by pivot 114. The pivot 114 is a stud having its first end 116 pressed into the bracket and has a head 117 on the second end. The bracket is attached to the window frame 117 by screws 118 and 119. The lever 114 has a first end 120 and a second end 121. The first end 120 may have a soft tip 122 which may be made up of a material that is soft and pliable and has a relatively high coefficient of friction to the material of which the windows are made. Also, it should be non-abrasive so that it will not injure the surface of the window sash 123 and 124.

The window shown is of the usual type of double hung window having an upper sash 124 and a lower 123 that slides up and down relative to each other. The window has a frame 117 to which the bracket 113 may be attached by means of screws in holes 118 and 119 as shown above. The bracket 113 has a boss 126 which holds the lever out in spaced relation to the window frame an amount sufficient that the tip will clear the bracket.

In the embodiment of FIGS. 2, 3 and 4, the bracket 113 is of sufficient length that the end 130 will engage the window and provide the precise proper spacing for the pivot 114 from the window, thereby simplifying the procedure of installing the lock on the window by providing a precise spacer.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination a lock (11) and a window (12) comprising, a bracket (113) attached to the frame (25) of said window comprising, a lever (115), pivot means connecting said lever (115) to said bracket (113), said lever (115) having a soft frictional member (122) on one end thereof, pivot means (114) connecting said lever to said bracket, said bracket having mounting means for mounting said lock on said window frame at a distance spaced from said window sash sufficient to allow said lever to be swung down and said soft frictional member to engage said window sash with said lever at an acute angle to a horizontal whereby said lever is wedged between said pivot member and said window sash, said bracket having one end (130) resting against said window sash (123) positively locating said bracket relative to said sash, said end of said bracket opposite said window sash has a boss thereon holding said lever in spaced relation to said bracket.

* * * * *